US010886665B2

(12) United States Patent
Yamada et al.

(10) Patent No.: US 10,886,665 B2
(45) Date of Patent: Jan. 5, 2021

(54) SERVICE PLUG

(71) Applicant: Yazaki Corporation, Tokyo (JP)

(72) Inventors: Go Yamada, Kakegawa (JP); Osamu Yanagisawa, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/686,420

(22) Filed: Nov. 18, 2019

(65) Prior Publication Data

US 2020/0083641 A1 Mar. 12, 2020

Related U.S. Application Data

(63) Continuation of application No. PCT/JP2018/020868, filed on May 30, 2018.

(30) Foreign Application Priority Data

Jun. 20, 2017 (JP) ..... 2017-120332

(51) Int. Cl.
*H01R 13/629* (2006.01)

(52) U.S. Cl.
CPC . *H01R 13/62938* (2013.01); *H01R 13/62955* (2013.01)

(58) Field of Classification Search
CPC ..... H01R 13/62938; H01R 13/62955
See application file for complete search history.

(56) References Cited

U.S. PATENT DOCUMENTS

| | | | | |
|---|---|---|---|---|
| 5,320,544 | A | 6/1994 | Naoto et al. | |
| 6,217,354 | B1 | 4/2001 | Fencl et al. | |
| 8,734,170 | B2 * | 5/2014 | Ikeda | H01R 13/62955 439/157 |
| 8,915,749 | B2 * | 12/2014 | Ikeda | H01H 3/06 439/157 |
| 8,986,024 | B2 * | 3/2015 | Ikeda | H01H 9/102 439/157 |
| 9,048,036 | B2 * | 6/2015 | Kikuchi | H01H 9/26 |
| 9,048,045 | B2 * | 6/2015 | Henmi | H01R 13/62933 |
| 9,171,685 | B2 * | 10/2015 | Henmi | H01H 35/003 |
| 9,391,400 | B2 * | 7/2016 | Henmi | B60L 3/04 |
| 9,824,837 | B2 * | 11/2017 | Ooishi | H01R 13/62938 |

(Continued)

FOREIGN PATENT DOCUMENTS

| | | | |
|---|---|---|---|
| DE | 10-2006-033909 | A1 | 2/2007 |
| EP | 0599332 | A1 | 6/1994 |

(Continued)

*Primary Examiner* — Abdullah A Riyami
*Assistant Examiner* — Nader J Alhawamdeh
(74) *Attorney, Agent, or Firm* — Sughrue Mion, PLLC

(57) ABSTRACT

A service plug includes a first connector housing that accommodates a first terminal, a second connector housing that accommodates a second terminal, and a lever that is rotatably provided about a rotation shaft of the second connector housing, that has a cam groove into which a cam pin of the first connector housing is engaged, and that brings the second connector housing into a disengagement state when the lever is in a first operation position and brings the second connector housing into an engagement state when the lever is in a second operation position. The lever has a stopping wall at a terminal end of the cam groove.

6 Claims, 10 Drawing Sheets

(56) References Cited

U.S. PATENT DOCUMENTS

| | | | | |
|---|---|---|---|---|
| 10,263,366 | B2 * | 4/2019 | Yanagisawa ..... | H01R 13/62938 |
| 2007/0026706 | A1 | 2/2007 | Matsubara et al. | |
| 2009/0311893 | A1 | 12/2009 | Sugiyama et al. | |
| 2013/0065412 | A1 * | 3/2013 | Ikeda ..... | H01R 13/62938<br>439/157 |
| 2013/0237078 | A1 * | 9/2013 | Ikeda ..... | H01R 13/62938<br>439/157 |
| 2016/0379778 | A1 | 12/2016 | Ooishi et al. | |
| 2018/0366874 | A1 * | 12/2018 | Yamada ..... | H01R 13/62977 |
| 2019/0109401 | A1 * | 4/2019 | Yamane ..... | H01R 13/62955 |

FOREIGN PATENT DOCUMENTS

| | | | |
|---|---|---|---|
| JP | 5-290921 | A | 11/1993 |
| JP | 2002-216894 | A | 8/2002 |
| JP | 2006-120535 | A | 5/2006 |
| JP | 2009-301926 | A | 12/2009 |
| JP | 2012-119292 | A | 6/2012 |

* cited by examiner

SERVICE PLUG

CROSS REFERENCE TO RELATED APPLICATIONS

This application is a continuation of PCT application No. PCT/JP2018/020868, which was filed on May 30, 2018 based on Japanese Patent Application (No. 2017-120332) filed on Jun. 20, 2017, the contents of which are incorporated herein by reference.

BACKGROUND OF THE INVENTION

1. Field of the Invention

The present invention relates to a service plug.

2. Description of the Related Art

There has been proposed a service plug including a first connector housing on a mounting side to a vehicle or the like, a second connector housing that can be inserted into or removed from the first connector housing, and a lever that is rotatably mounted on the second connector housing to apply a force to the second connector housing in an insertion/removal direction with respect to the first connector housing (see JP-A-2012-119292).

The service plug is provided between a vehicle battery and a load, and when some work on a load side is performed, a lever operation is performed to remove the second connector housing together with the lever from the first connector housing from a viewpoint of ensuring safety of an operator.

However, the service plug described in JP-A-2012-119292 is assumed to remove a grip portion including the second connector housing and the lever. Therefore, a space for removing the grip portion is required on the service plug.

In the service plug described in JP-A-2012-119292, the grip portion is removed. Therefore, dropping of the grip portion (removal side components) may cause failure in use, and intrusion of foreign matters into the first connector housing whose inside is exposed is also possible.

SUMMARY OF THE INVENTION

The present invention has been made in order to solve such a problem in related art, and an object thereof is to provide a service plug that does not require a space for removal, and is capable of preventing failure in use due to dropping of removal side components, and intrusion of foreign matters into a first connector housing.

The object of the present invention is achieved by a service plug having the following configuration.

(1) A service plug includes: a first connector housing that accommodates a first terminal extending in a predetermined direction; a second connector housing that accommodates a second terminal facing the first terminal and extending in a direction the same as that of the first terminal, and the second connector housing being engaged to the first connector housing; and a lever that is rotatably provided about a rotation shaft provided on the second connector housing, that is provided with a cam groove into which a cam pin provided on the first connector housing is engaged, and that brings the second connector housing into a disengagement state when the lever is in a first operation position and brings the second connector housing into an engagement state when the lever is in a second operation position by cooperation of the cam pin and the cam groove. When the lever is in the first operation position, the lever has, at a terminal end of the cam groove, a stopping wall that prevents the cam pin within the cam groove from falling in a direction in which the second connector housing makes a transition from the engagement state to the disengagement state.

According to the service plug having the configuration (1), the terminal end of the cam groove is provided with a stopping wall that prevents the cam pin from falling from the cam groove when the lever is in the first operation position. Therefore, even if an operator tries to remove a second connector housing side, the cam pin cannot be easily removed by being blocked by the stopping wall. Therefore, removal on the second connector housing side is basically impossible, and a space for removal is not required. In addition, since the configuration is basically incapable of being removed, dropping of removal side components or intrusion of foreign matters into the first connector housing are impossible. Therefore, the space for removal is not required, and failure in use due to dropping of the removal side components and intrusion of the foreign matters into the first connector housing can be prevented.

(2) In the service plug according to (1), the second connector housing is displaced in a parallel direction with respect to a mounting surface to which the first connector housing is mounted.

According to the service plug having the configuration (2), the second connector housing is displaced in the parallel direction with respect to the mounting surface to which the first connector housing is mounted. Therefore, as compared with a case where the second connector housing is displaced perpendicularly to the mounting surface, the required space on the service plug can be further reduced.

(3) In the service plug according to (1) or (2), the lever brings the second connector housing into a half-engagement state with respect to the first connector housing when the lever is in a third operation position which is located between the first operation position and the second operation position.

According to the service plug having the configuration (3), when the lever reaches the third operation position, the second connector housing is in the half-engagement state with respect to the first connector housing. In the half-engagement state, a first terminal and a second terminal are brought into contact with each other, but a switch unit provided on a current path is turned off while two signal terminals in an interlock connector provided in the first connector housing are non-conductive, and the current path from a vehicle battery to a load can be cut off.

(4) In the service plug according to (3), the lever and the second connector housing have a lock mechanism that cannot be released only by rotating the lever.

According to the service plug having the configuration (4), even if the operator rotates the lever from the third operation position toward the first operation position, an engaged state of the lock mechanism cannot be released. Therefore, the lever can be prevented from being inadvertently rotated to the first operation position, and the second connector housing can be prevented from undesirably coming into the disengagement state with respect to the first connector housing.

According to the present invention, a service plug can be provided which does not require a space for removal, and is capable of preventing failure in use due to dropping of removal side components, and intrusion of foreign matters into a first connector housing.

DESCRIPTION OF EMBODIMENTS

Hereinafter, the present invention will be described according to a preferred embodiment. The present invention is not limited to the embodiment described below, and can be appropriately modified without departing from the scope of the present invention. In the embodiment described below, some configurations are not shown or described, but it goes without saying that a known or well-known technique is appropriately applied to details of an omitted technique within a range in which no contradiction occurs to contents described below.

Figure 1:
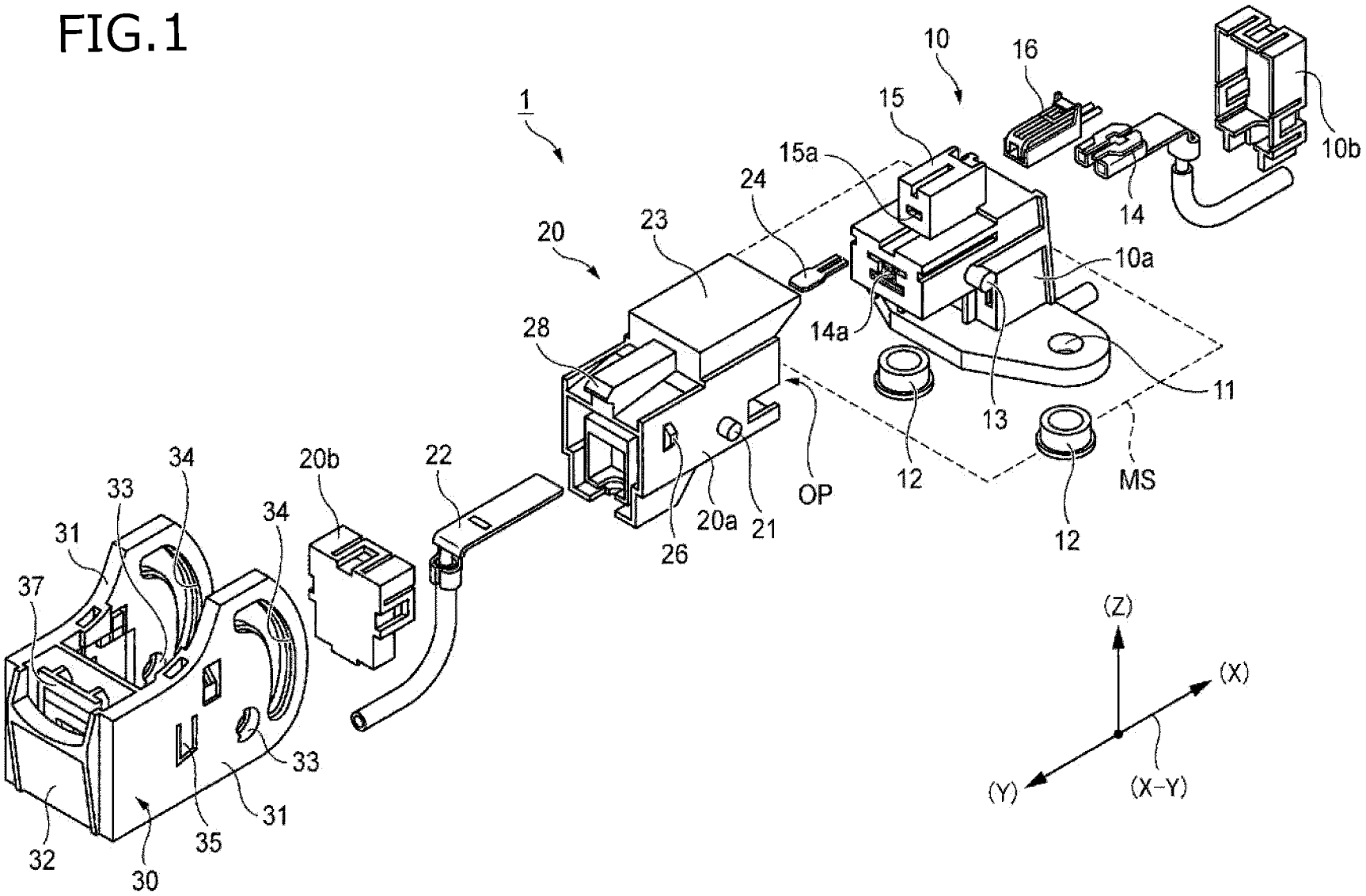
FIG. 1 is an exploded view showing a service plug according to an embodiment of the present invention.

FIGS. 1 to 7 are configuration diagrams showing a service plug according to the embodiment of the present invention. As shown in FIG. 1, a service plug 1 according to the present embodiment is provided between a vehicle battery and a load, and includes a first connector housing 10, a second connector housing 20 and a lever 30.

For convenience of description, in FIG. 1, an arrow (X) indicates a fitting direction of the service plug 1, an arrow (Y) indicates a detaching direction of the service plug 1, an arrow (Z) indicates an upward direction of the service plug 1, and arrows (X-Y) respectively indicate an insertion and a removal direction of the second connector housing 20 with respect to the first connector housing 10.

The first connector housing 10 is a connector that is mounted to a mounting surface MS of a vehicle or the like and serves as a fixed side. The second connector housing 20 is a mating connector that is engaged to the first connector housing 10. The lever 30 acts on the second connector housing 20 by applying a fitting force or a detaching force with respect to the first connector housing 10. In the present embodiment, the second connector housing 20 is movable in a parallel direction (an insertion/removal direction X-Y) with respect to the mounting surface MS by an operation of the lever 30. Each portion will be described in detail below.

Figure 2:
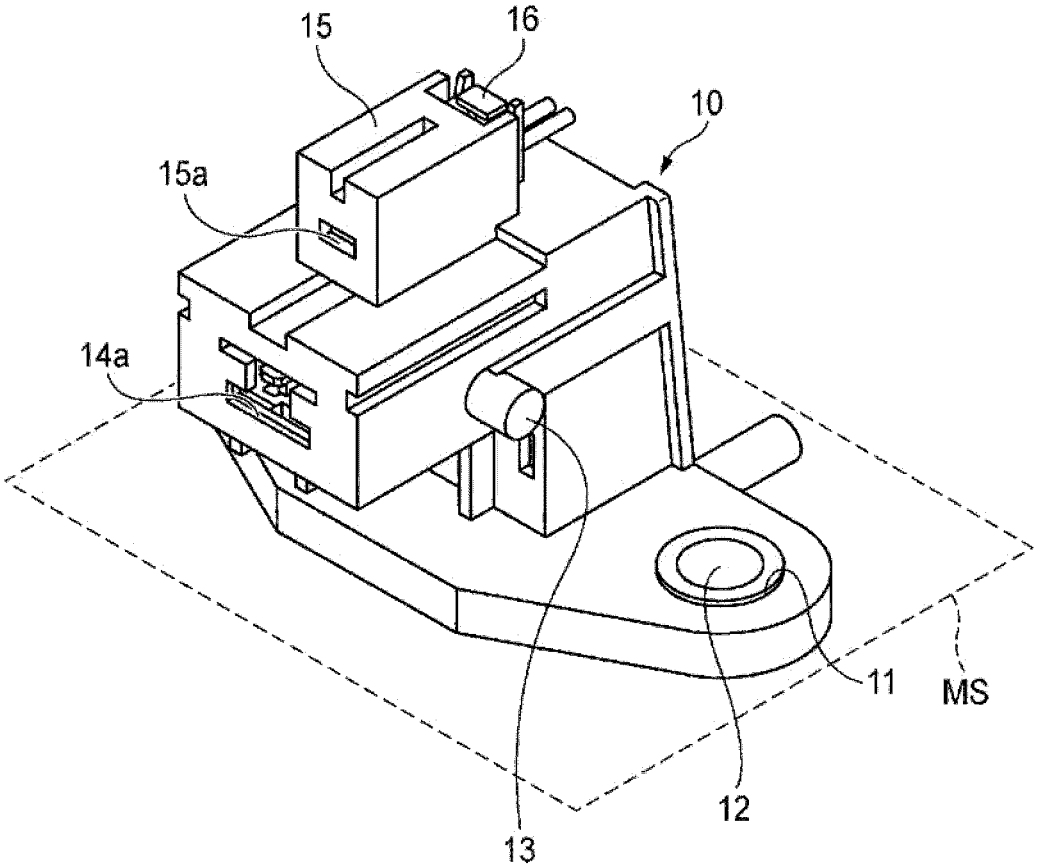
FIG. 2 is a perspective view showing a first connector housing of the service plug shown in FIG. 1.

The first connector housing 10 shown in FIGS. 1 and 2 includes a main body portion 10*a* and a rear cover 10*b* mounted to the main body portion 10*a* on a fitting direction (X) side. Two mounting ports 11 (only one shown in a perspective view) for mounting to the mounting surface MS are formed in the main body portion 10*a*. Collars 12 are mounted to the mounting ports 11, and bolting or the like is performed.

The main body portion 10*a* includes cam pins 13 on both side surfaces thereof. The cam pin 13 is engaged into a cam groove (see reference numeral 34) described below of the lever 30. The first connector housing 10 accommodates a female terminal (a first terminal) 14 in an internal space formed by the main body portion 10*a* and the rear cover 10*b* in a state of extending in the insertion/removal direction (X-Y) that is an example of a predetermined direction.

The female terminal 14 is formed by punching and bending a conductive metal plate, and has a shape into which a male terminal (see reference numeral 22) described below is inserted. The main body portion 10*a* has an opening 14*a* connected to the accommodation space of the female terminal 14 on a detaching direction (Y) side thereof. The male terminal described below can be electrically connected to the female terminal 14 through the opening 14*a*. The female terminal 14 includes therein an elastic piece 14*b* serving as a contact portion with the male terminal (see FIGS. 8 to 10 described below).

A hood portion 15 is formed on an upper portion of the main body portion 10*a*. An interlock connector 16 is inserted and fixed to the hood 15 from the fitting direction (X) side. The hood portion 15 has an insertion opening 15*a* into which an interlock terminal described below (see reference numeral 24) is inserted at a surface on the detaching direction (Y) side. In addition, two signal terminals (not shown) are provided in the interlock connector 16.

Although not shown, the two signal terminals in the interlock connector 16 are connected to a switch unit provided on a current path from the vehicle battery to the load. When the two signal terminals are electrically connected and conductive, the switch unit is turned on to bring the current path into conduction. On the other hand, when the two signal terminals are not electrically connected and non-conductive, the switch unit is turned off to cut off the current path.

Figure 3:
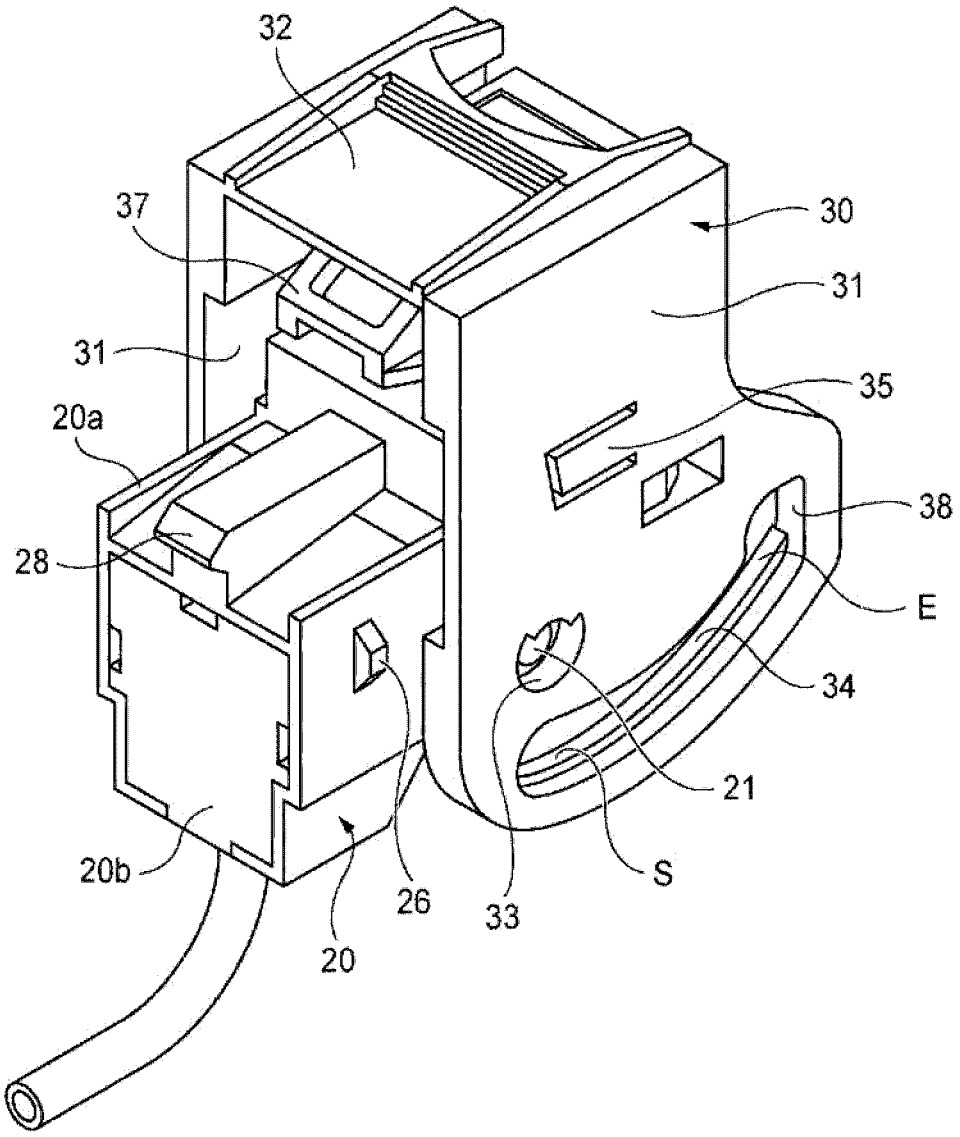
FIG. 3 is a perspective view showing a second connector housing and a lever of the service plug shown in FIG. 1.

The second connector housing 20 shown in FIGS. 1 and 3 includes a main body portion 20*a* and a rear cover 20*b* that is mounted to the main body portion 20*a* from the detaching direction (Y) side. The main body 20*a* includes a rotation shaft 21 on both side surfaces thereof. The rotation shaft 21 is engaged into a rotation bearing described below (see reference numeral 33) of the lever 30, and serves as a rotation center of the lever 30 that is rotatably operated.

Such a second connector housing 20 includes a fitting chamber OP opened on the fitting direction (X) side. A male terminal (a second terminal) 22 is fixedly mounted and accommodated in the fitting chamber OP. In this fixed state (an engagement state, a disengagement state and a half-engagement state to be described below), the male terminal 22 is disposed to face the female terminal 14 in a state of extending in the same direction (the insertion/removal direction (X-Y)). The fitting chamber OP is closed by the rear cover 20*b* on the detaching direction (Y) side.

The male terminal 22 is formed by punching and bending a conductive metal plate, and can be inserted into the female terminal 14. The male terminal 22 moves in the insertion/removal direction (X-Y) in accordance with movement of the second connector housing 20, and is inserted into or removed from the female terminal 14.

The second connector housing 20 includes a hood portion 23 on an upper portion thereof. The hood portion 23 is configured to be able to be engaged to the hood portion 15 of the first connector housing 10, and includes an interlock terminal 24 therein. The interlock terminal 24 is made of a conductive metal material, moves in the insertion/removal direction (X-Y) in accordance with the movement of the second connector housing 20, and is inserted into or removed from the interlock connector 16 in the hood 15. When the interlock terminal 24 is inserted into the interlock connector 16, the two signal terminals in the interlock connector 16 are electrically connected via the interlock terminal 24. Thereby, the switch unit provided on the current path from the vehicle battery to the load is turned on to bring the current path into conduction.

The lever 30 includes a pair of arm plates 31 and a connection portion 32 that connects one ends of the pair of arm plates 31. In the pair of arm plates 31, a rotation bearing 33 to which the rotation shaft 21 of the second connector housing 20 is engaged is formed. A cam groove 34 into which the cam pin 13 formed in the first connector housing 10 is engaged is formed in each of the pair of arm plates 31. When the cam pin 13 is engaged into the cam groove 34, the lever 30 rotates about the rotation shaft 21 while the cam pin 13 moves in the cam groove 34 (see FIGS. 5 to 7).

Figure 4:
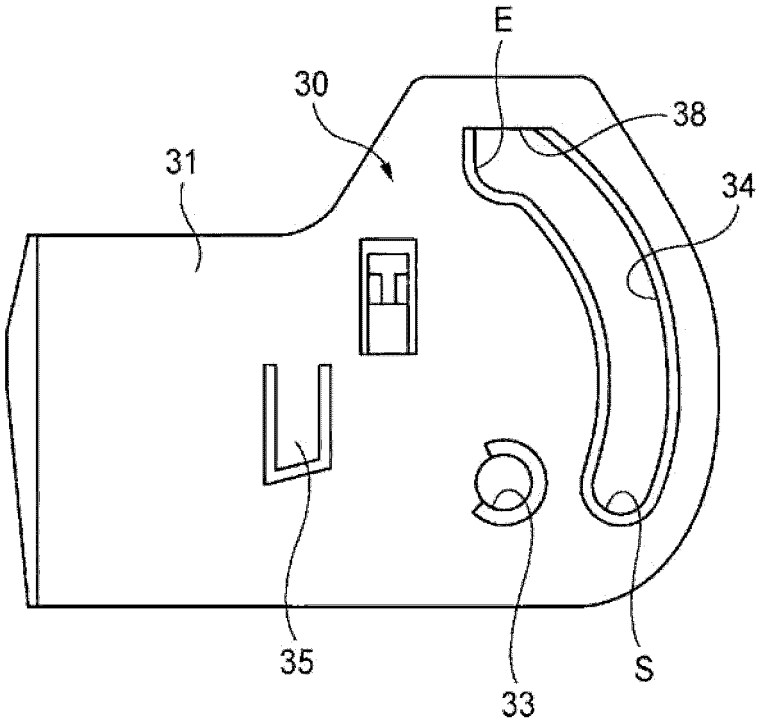
FIG. 4 is a plan view showing the lever of the service plug shown in FIG. 1.
Figure 5:
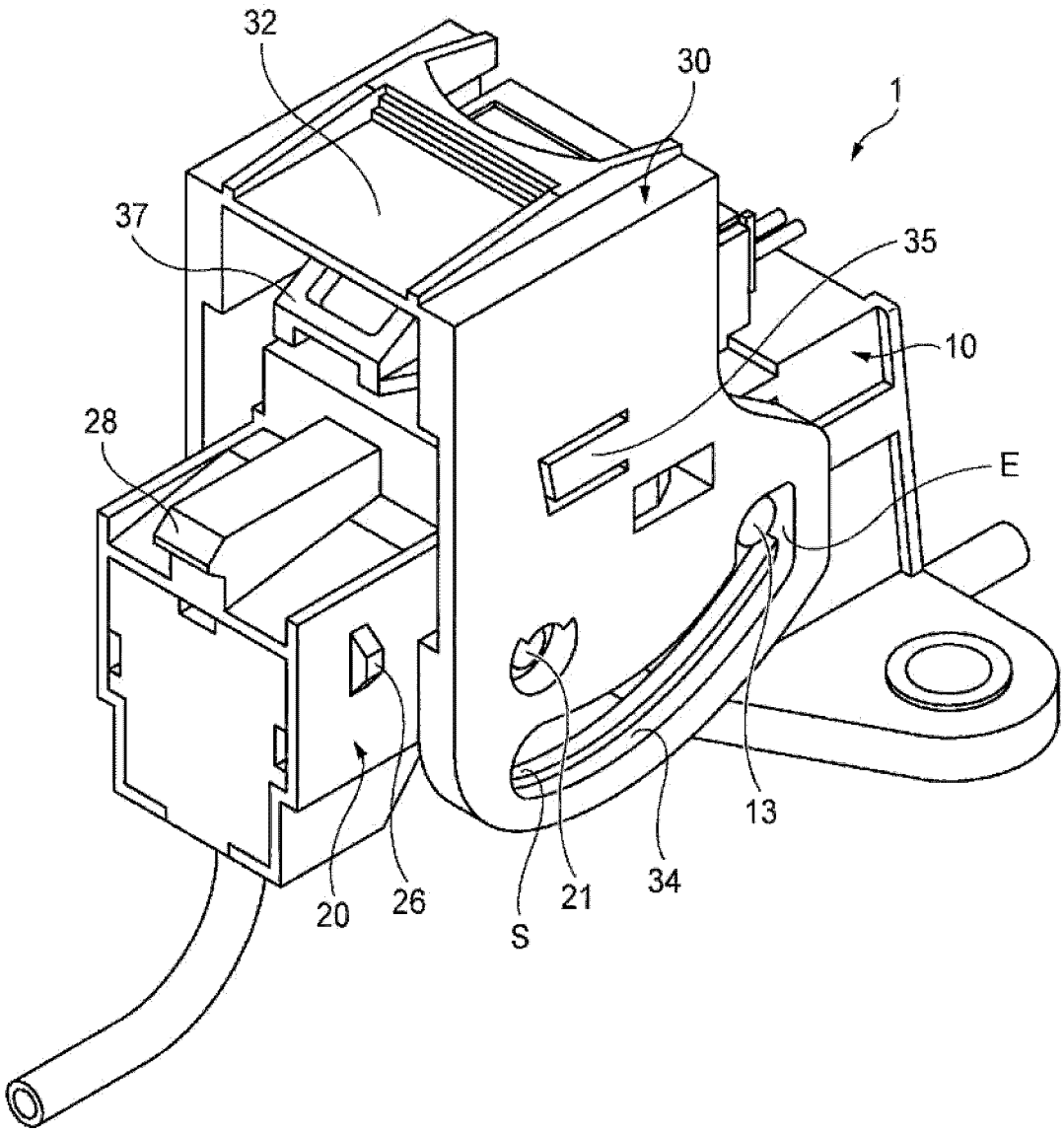
FIG. 5 is a perspective view when the lever shown in FIG. 1 is in a first operation position.

As shown in FIG. 4, the cam groove 34 formed in the arm plate 31 has a curved structure in which the distance from the rotation bearing 33 gradually changes. Due to the curved structure, when the lever 30 is rotated, the cam pin 13 moves close to or away from the rotation shaft 21. That is, the fitting force or the detaching force is applied to the second connector housing 20 by cooperation of the cam pin 13 and the cam groove 34.

Specifically, when the lever 30 is in a first operation position (see FIG. 5), that is, when the lever 30 is perpendicular to the mounting surface MS, the cam pin 13 is located at a terminal end E of the cam groove 34 (a portion of the cam groove 34 farthest from the rotation shaft 21). The second connector housing 20 is in a disengagement state with respect to the first connector housing 10. On the other hand, when the lever 30 is in a second operation position (see FIG. 6), that is, when the lever 30 is parallel to the mounting surface MS, the cam pin 13 is located at the other end S of the cam groove 34 (a portion of the cam groove 34 closest to the rotation shaft 21). The second connector housing 20 is in an engagement state with respect to the first connector housing 10.

Therefore, when the lever 30 is rotated between the first operation position and the second operation position, the fitting force or the detaching force acts on the second connector housing 20. Then, the second connector housing 20 is in an engagement state or a disengagement state with respect to the first connector housing 10.

Figure 7:
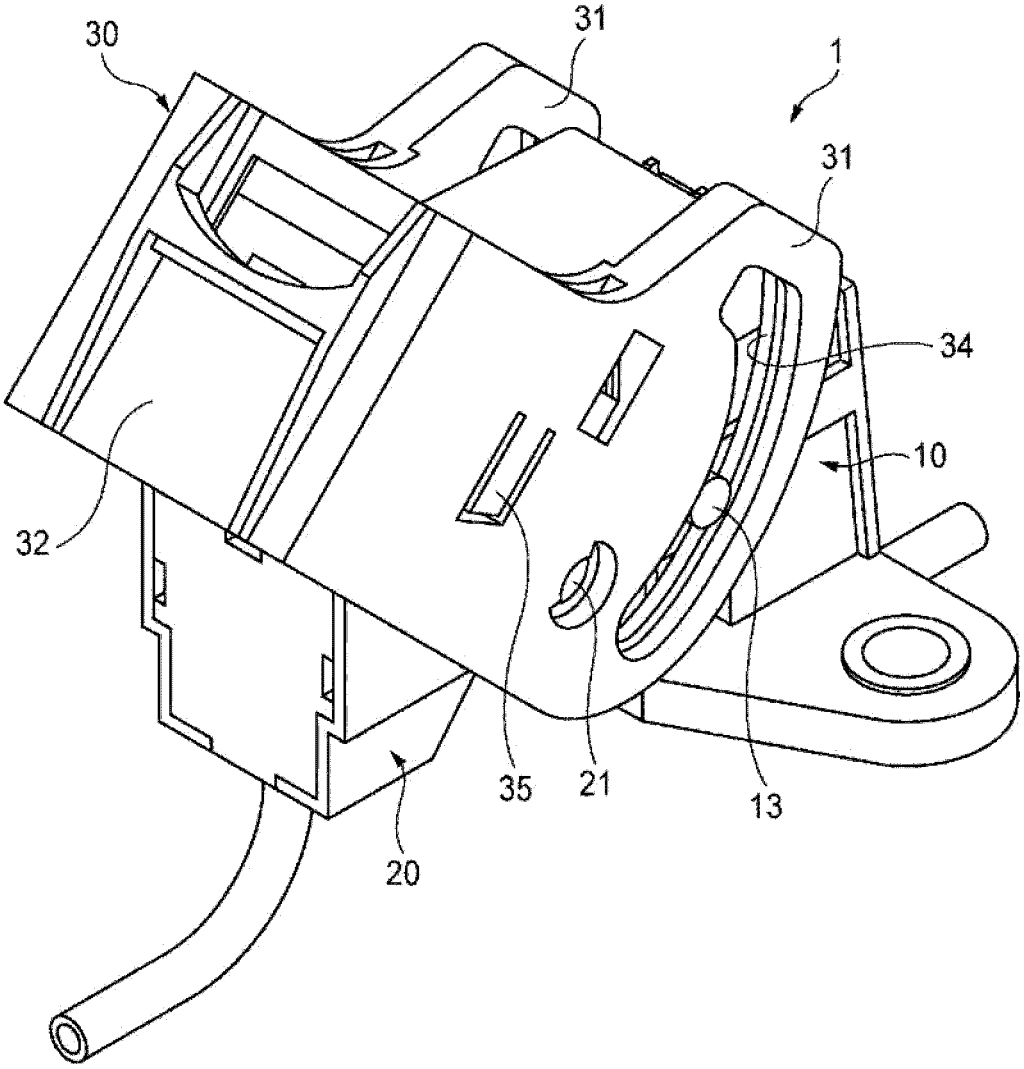
FIG. 7 is a perspective view when the lever shown in FIG. 1 is in a third operation position.

Here, the lever 30 can be in a third operation position between the first operation position and the second operation position (see FIG. 7). Further, lock mechanism is provided in the lever 30 and the second connector housing 20, and is configured to be able to hold a position of the lever 30 and the second connector housing 20 in the second operation position and the third operation position. This point will be described in detail below.

As shown in FIGS. 1, 3 and the like, a locking piece 35 that is elastically deformable in a direction substantially perpendicular to a plane of the arm plate 31 is form in each of the pair of arm plates 31. The second connector housing 20 includes lock claws 26 on both side surfaces on the detaching direction (Y) side.

Figure 6:
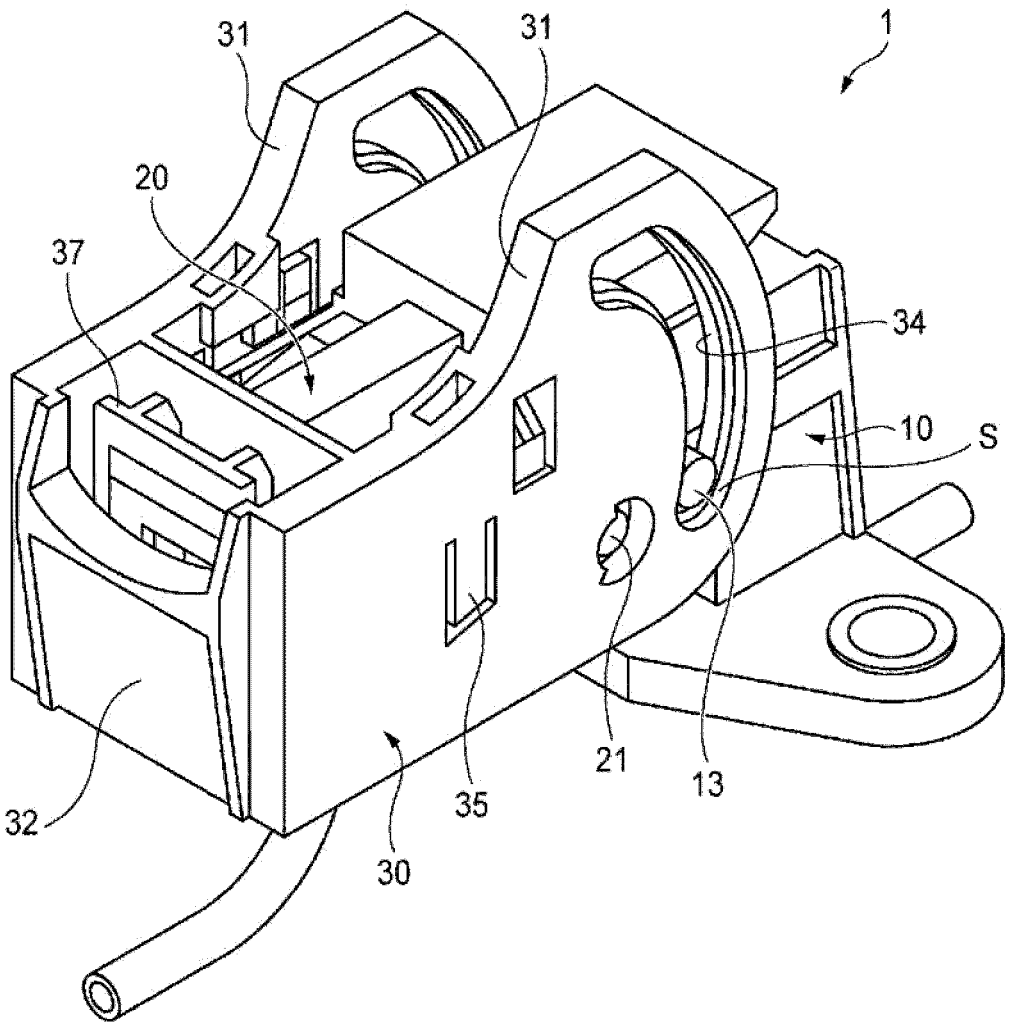
FIG. 6 is a perspective view when the lever shown in FIG. 1 is in a second operation position.

When the lever 30 is in the second operation position shown in FIG. 6, that is, when the second connector housing 20 is in the engagement state with respect to the first connector housing 10, the lock pieces 35 and the lock claws 26 form the lock mechanism serving to maintain the position.

Engagement between the lock pieces 35 and the lock claws 26 is set to a degree that can be released by rotating the lever 30 by an operator. That is, the operator can release the engagement by rotating the lever 30 from the second operation position toward the first operation position (the third operation position).

Further, the lever 30 includes an elastic piece 37 on an inner side surface of the connection portion 32. The elastic piece 37 is a plate member having a substantially V-shaped cross section (see FIGS. 8 to 10 described below), and is elastically deformable toward the connection portion 32. The second connector housing 20 includes a lock claw 28 at an upper portion slightly on the detaching direction (Y) side with respect to a position where the lock claw 26 is provided. The lock claw 28 has a shape projecting toward the detaching direction (Y) side. In the elastic piece 37, an engagement piece 37*a* (see FIGS. 8 to 10 described below) is formed in vicinity of a vertex portion of the V-shape, and can be engaged by being caught by the lock claw 28.

When the lever 30 is in the third operation position shown in FIG. 7, that is, when the second connector housing 20 is the half-engagement state with respect to the first connector housing 10, the elastic piece 37 and the lock claw 28 forms the lock mechanism serving to maintain the position.

Engagement between the elastic piece 37 and the lock claw 28 cannot be released by rotating the lever 30 by the operator. That is, even if the operator rotates the lever 30 from the third operation position toward the first operation position, the engagement cannot be released. When the operator desires to rotate the lever 30 to the first operation position, the operator directly performs operation to bend the elastic piece 37 so that a position of the engagement piece 37*a* is displaced toward the connection portion 32. Thereby, the engagement between the elastic piece 37 and the lock claw 28 is released. The operator can move the lever 30 to the first operation position by rotating the lever 30 while maintaining the released state.

Here, in the present embodiment, the lever 30 includes a stopping wall 38 (see FIG. 3). The stopping wall 38 is a wall portion provided at the terminal end E of the cam groove 34, and prevents the cam pin 13 within the cam groove 34 from falling in a direction (that is, the detaching direction (Y) side) in which the second connector housing 20 makes a transition from the engagement state to the disengagement state when the lever 30 is in the first operation position.

As described above, the service plug 1 according to the present embodiment is configured not to assume removal of the second connector housing 20 and the lever 30. That is, a cam pin entrance (a thin portion) is formed at a terminal end of the cam groove in the lever described in JP-A-2012-119292, but such an entrance is not formed in the present embodiment, and basically the cam pin 13 does not come out from the cam groove 34. Thereby, the lever 30 is engaged to both the cam pin 13 and the rotation shaft 21, so that the first connector housing 10 and the second connector housing 20 are integrated via the lever 30 and the removal is not assumed.

Figure 8:
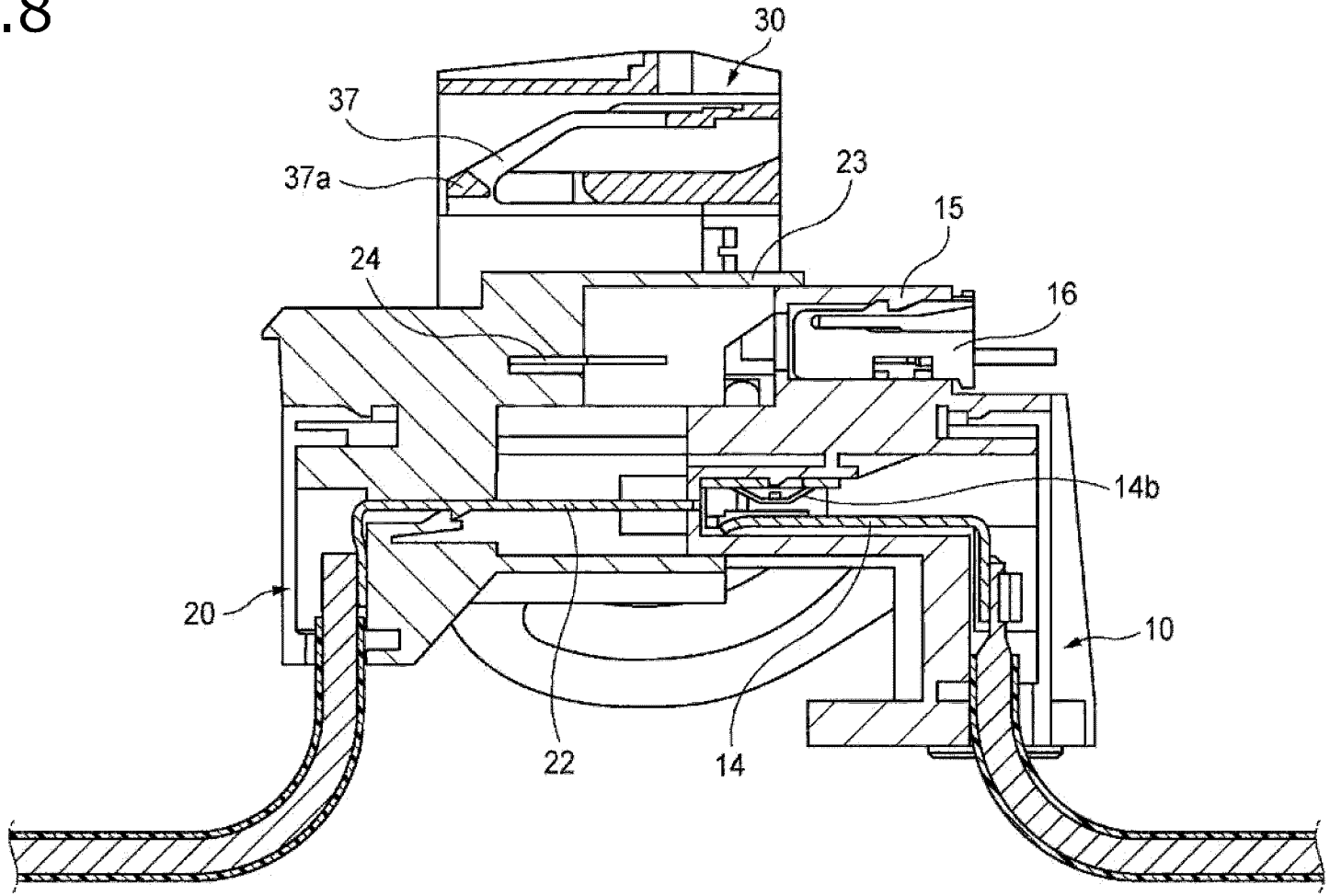
FIG. 8 is a cross-sectional view when the lever shown in FIG. 1 is in the first operation position.
Figure 9:
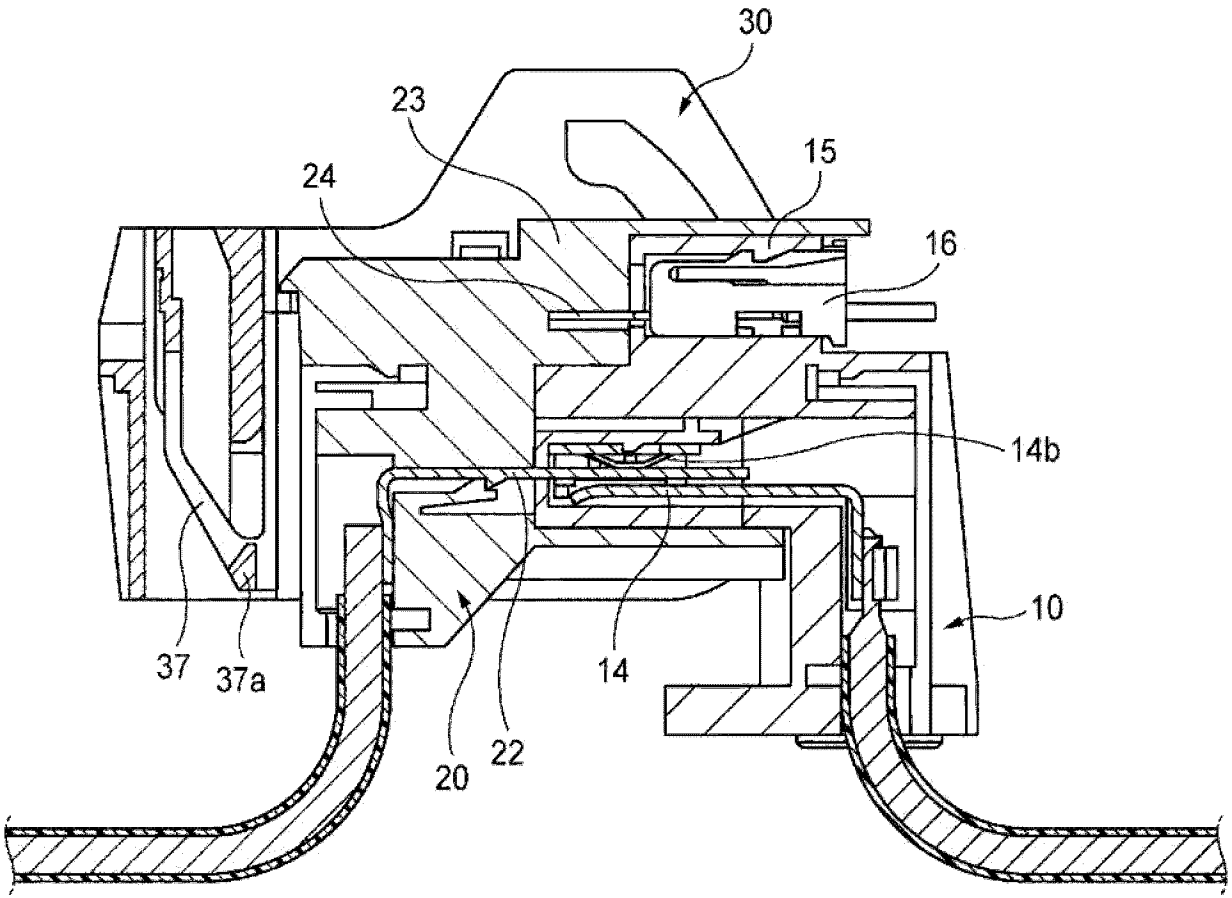
FIG. 9 is a cross-sectional view when the lever shown in FIG. 1 is in the second operation position.
Figure 10:
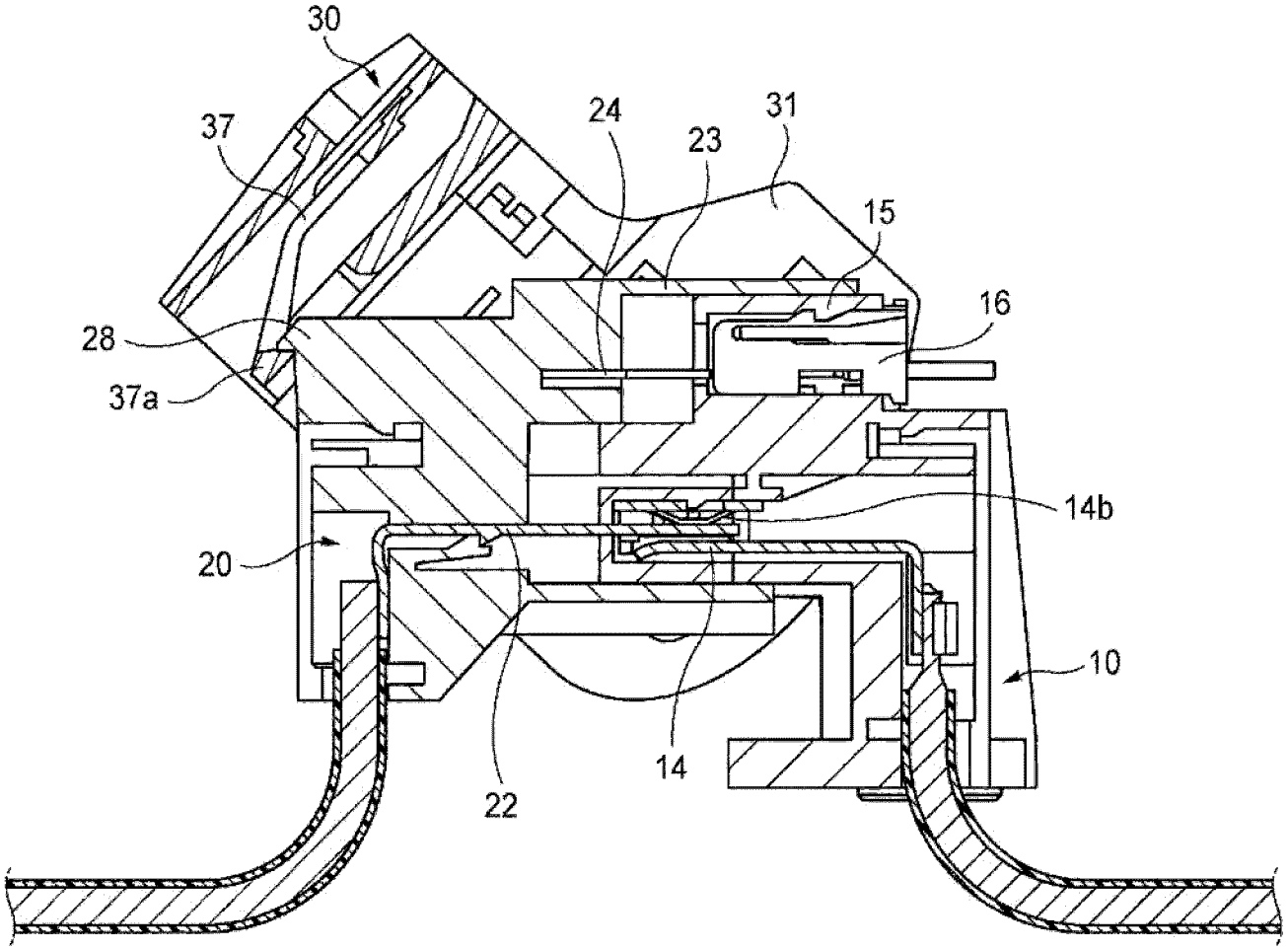
FIG. 10 is a cross-sectional view when the lever shown in FIG. 1 is in the third operation position.

FIG. 8 is a cross-sectional view when the lever 30 shown in FIG. 1 is in the first operation position, FIG. 9 is a cross-sectional view when the lever 30 shown in FIG. 1 is in the second operation position, and FIG. 10 is a cross-sectional view when the lever 30 shown in FIG. 1 is in the third operation position.

Next, an operation from the disengagement state to the engagement state of the second connector housing 20 will be described. First, the operator pushes and spreads an end (an end on a rotation center side) of the lever 30 on an opposite side to the connection portion 32. Then, in accordance with shape return of the lever 30, the rotation shaft 21 is engaged into the rotation bearing 33, and the cam pin 13 is engaged into the cam groove 34. In addition, the cam pin 13 is engaged so as to be positioned at the terminal end E of the cam groove 34. At this time, the second connector housing 20 is in the disengagement state shown in FIG. 5.

Next, the operator rotates the lever 30 toward the second operation position. Thereby, the cam pin 13 moves toward the other end S in the cam groove 34. In particular, since the distance between the cam groove 34 and the rotation bearing 33 gradually decreases toward the other end S, a fitting force with respect to the first connector housing 10 in a fitting direction (X) acts on the second connector housing 20, and the second connector housing 20 is engaged into the first connector housing 10 in accordance with rotation amount of the lever 30.

When the lever 30 reaches the third operation position, the engagement piece 37*a* of the elastic piece 37 and the lock claw 28 are engaged (see FIG. 10). In this state, the second connector housing 20 is in the half-engagement state, and the male terminal 22 is inserted into the female terminal 14 to be in contact. On the other hand, in the half-engagement state, the hood portion 23 of the second connector housing 20 is not engaged to the hood portion 15 of the first connector housing 10. Therefore, the interlock terminal 24 in the hood portion 23 is not completely inserted into the interlock connector 16 in the hood portion 15, and the switch unit (not shown) is turned off. That is, the current path from the vehicle battery to the load is cut off.

Thereafter, when the operator further rotates the lever 30 toward the second operation position, the lever 30 reaches the second operation position, and the lock pieces 35 and the lock claws 26 are engaged. In this state, the second connector housing 20 is in the engagement state, and the male terminal 22 is inserted into the female terminal 14 to be in the contact (see FIG. 9). Further, in the engagement state, the hood portion 23 of the second connector housing 20 is engaged to the hood portion 15 of the first connector housing 10. Accordingly, the interlock terminal 24 in the hood 23 is completely inserted into the interlock connector 16 in the hood 15, and the switch unit (not shown) is turned on. That is, the current path from the vehicle battery to the load is brought into conduction.

Next, an operation from the engagement state to the disengagement state of the second connector housing 20 will be described. First, it is assumed that the lever 30 is in the second operation position and the second connector housing 20 is in the engagement state. From this state, the operator rotates the lever 30 toward the first operation position (the third operation position). Accordingly, the cam pin 13 moves toward the terminal end E in the cam groove 34. In particular, since the distance between the cam groove 34 and the rotation bearing 33 gradually increases toward the terminal end E, a detaching force with respect to the first connector housing 10 in a detaching direction (Y) acts on the second connector housing 20, and the second connector housing 20 is gradually detached from the first connector housing 10 in accordance with the rotation amount of the lever 30. The engagement between the lock pieces 35 and the lock claws 26 is released during the rotation operation.

Thereafter, when the lever 30 reaches the third operation position, the engagement piece 37*a* of the elastic piece 37 is engaged with the lock claw 28 (see FIG. 10). In this state, the second connector housing 20 is in the half-engagement state, and the male terminal 22 is inserted into the female terminal 14 to be in a contact, but the interlock terminal 24 is not completely inserted into the interlock connector 16, and the switch unit (not shown) is turned off. That is, the current path from the vehicle battery to the load is cut off.

Here, even if the operator rotates the lever 30 toward the first operation position, the engagement piece 37*a* of the elastic piece 37 and the lock claw 28 are engaged, so that the engaged state cannot be released. Therefore, the operator directly performs operation to bend the elastic piece 37 so that the position of the engagement piece 37*a* is displaced toward the connection portion 32. Thereby, the engagement between the engagement piece 37*a* of the elastic piece 37 and the lock claw 28 is released. Thereafter, the operator rotates the lever 30 toward the first operation position while maintaining the released state.

When the lever 30 reaches the first operation position, the second connector housing 20 is in the disengagement state. Therefore, as shown in FIG. 8, the male terminal 22 is not inserted into the female terminal 14 and is not in contact. Therefore, the current path from the vehicle battery to the load is cut off. Further, the interlock terminal 24 is not inserted into the interlock connector 16, and the switch unit (not shown) is turned off.

Here, it is assumed that the operator holds the lever 30 or the second connector housing 20 and tries to move the second connector housing 20 in the detaching direction (Y). In this case, as shown in FIG. 3, the lever 30 according to the present embodiment includes the stopping wall 38 at the terminal end E of the cam groove 34 to prevent the cam pin 13 from falling in the detaching direction (Y). Therefore, the cam pin 13 contacts the stopping wall 38 and is prevented from falling in the detaching direction (Y). That is, the second connector housing 20 and the lever 30 are basically not removed from the first connector housing 10, and a space for removal is not required. In addition, failure in use due to dropping of removal side components such as the second connector housing 20 and the lever 30, and intrusion of foreign matters into the first connector housing 10 are prevented.

In this way, according to the service plug 1 according to the present embodiment, the terminal end E of the cam groove 34 is provided with the stopping wall 38 that prevents the cam pin 13 from falling from the cam groove 34 when the lever 30 is in the first operation position. Therefore, even if the operator tries to remove a second connector housing 20 side, the cam pin 13 cannot be easily removed by being blocked by the stopping wall 38. Therefore, removal on the second connector housing 20 side is basically impossible, and the space for removal is not required. In addition, since the configuration is basically incapable of being removed, dropping of the removal side components or intrusion of the foreign matters into the first connector housing 10 are impossible. Therefore, the space for removal is not required, and failure in use due to dropping of the removal side components and intrusion of the foreign matters into the first connector housing 10 can be prevented.

The second connector housing 20 is displaced in the parallel direction (the insertion/removal direction X-Y) with respect to the mounting surface MS to which the first connector housing 10 is mounted. Therefore, as compared with a case where the second connector housing 20 is displaced perpendicularly to the mounting surface MS, the required space on the service plug 1 can be further reduced.

The present invention has been described based on the embodiment, but the present invention is not limited to the embodiment described above and can be appropriately modified without departing from the scope of the present invention, and may be appropriately combined with techniques in embodiments. Further, other techniques may be appropriately combined within a possible range.

For example, the service plug 1 according to the present embodiment moves in the parallel direction (the insertion/removal direction X-Y) with respect to the mounting surface MS, but is not limited thereto, and may be configured to move in a vertical direction.

Here, features of the embodiment of the service plug according to the present invention described above are summarized briefly and listed below, respectively.

[1] A service plug (1) includes:

a first connector housing (10) that accommodates a first terminal (a female terminal 14) extending in a predetermined direction;

a second connector housing (20) that accommodates a second terminal (a male terminal 22) facing the first terminal (the female terminal 14) and extending in a direction the same as that of the first terminal (the female terminal 14), and the second connector housing (20) being engaged to the first connector housing (10); and a lever (30) that is rotatably provided about a rotation shaft (21) provided on the second connector housing (20), that is provided with a cam groove (34) into which a cam pin (13) provided on the first connector housing (10) is engaged, and that brings the second connector housing (20) into a disengagement state when the lever (30) is in a first operation position and brings the second connector housing (20) into an engagement state when the lever (30) is in a second operation position by cooperation of the cam pin (13) and the cam groove (34).

When the lever (30) is in the first operation position, the lever (30) has, at a terminal end (E) of the cam groove (34), a stopping wall (38) that prevents the cam pin (13) within the cam groove (34) from falling in a direction in which the second connector housing (20) makes a transition from the engagement state to the disengagement state.

[2] In the service plug according to [1], the second connector housing (20) is displaced in a parallel direction with respect to a mounting surface (MS) to which the first connector housing (10) is mounted.

[3] In the service plug according to [1] or [2], the lever (30) brings the second connector housing (20) into a half-engagement state with respect to the first connector housing (10) when the lever (30) is in a third operation position which is located between the first operation position and the second operation position.

[4] In the service plug according to [3], the lever (30) and the second connector housing (20) have a lock mechanism (an elastic piece 37 and a lock claw 28) that cannot be released only by rotating the lever (30).

According to the service plug of the present invention, the space for removal is not required, and failure in use due to dropping of the removal side components or intrusion of the foreign matters into the first connector housing can be prevented.

What is claimed is:

1. A service plug comprising:

a first connector housing that accommodates a first terminal extending in a predetermined direction;

a second connector housing that accommodates a second terminal facing the first terminal and extending in a direction the same as that of the first terminal, and the second connector housing being engaged to the first connector housing; and a lever that is rotatably provided about a rotation shaft provided on the second connector housing, that is provided with a cam groove into which a cam pin provided on the first connector housing is engaged, and that brings the second connector housing into a disengagement state when the lever is in a first operation position where the cam pin is located at a terminal end of the cam groove and brings the second connector housing into an engagement state when the lever is in a second operation position where the cam pin is located at the other end of the cam groove by cooperation of the cam pin and the cam groove, wherein the lever has, at the terminal end of the cam groove, a stopping wall that prevents the cam pin within the cam groove from moving in a direction in which the second connector housing makes a transition from the engagement state to the disengagement state, when the lever is in the first operation position, wherein the terminal end of the cam groove is closed by the stopping wall, and wherein when the lever is in the first operation position, the lever is perpendicular to the predetermined direction, and when the lever is in the second operation position, the lever is parallel to the predetermined direction.

2. The service plug according to claim 1, wherein the second connector housing is displaced in a parallel direction with respect to a mounting surface to which the first connector housing is mounted.

3. The service plug according to claim 1, wherein the lever brings the second connector housing into a half-engagement state with respect to the first connector housing when the lever is in a third operation position which is located between the first operation position and the second operation position.

4. The service plug according to claim 3, wherein the lever and the second connector housing have a lock mechanism that cannot be released only by rotating the lever.

5. The service plug according to claim 4, wherein the lever includes a pair of arm plates and a connection portion that connects one end of the pair of arm plates;

wherein the cam groove is provided in each arm plate of the pair of arm plates;

wherein the lock mechanism includes an elastic piece provided on an inner side surface of the connection portion and a lock claw provided on the second connector housing; and wherein the engagement piece engages with the lock claw.

6. The service plug according to claim 5, wherein each arm plate of the pair of arm plates has a locking piece; and wherein when the lever is in the second operation position, the lock pieces engage with the lock claws respectively to maintain a position of the lever to the second operation position.

* * * * *